United States Patent [19]

Janousek

[11] 4,319,235

[45] Mar. 9, 1982

[54] YARN-PIECING AND CLEANING SYSTEM FOR A SPINNING MACHINE

[75] Inventor: Radé Janousek, Mulhouse, France

[73] Assignee: Societe Alsacienne de Constructions Mecaniques de Mulhouse, Mulhouse, France

[21] Appl. No.: 174,898

[22] Filed: Aug. 4, 1980

[30] Foreign Application Priority Data

Aug. 10, 1979 [FR] France ..... 79 20447

[51] Int. Cl.[3] ..... G08B 21/00

[52] U.S. Cl. ..... 340/677; 19/0.21; 19/0.22; 19/0.25; 57/264; 66/163

[58] Field of Search ..... 340/677; 19/0.21, 0.22, 19/0.25; 66/163, 161; 57/263, 264; 226/11, 43, 45

[56] References Cited

U.S. PATENT DOCUMENTS

| | | | |
|---|---|---|---|
| 3,789,595 | 2/1974 | Bernstein et al. | 57/264 |
| 3,950,926 | 4/1976 | Stahlecker | 57/263 |
| 4,043,106 | 8/1977 | Stahlecker | 57/263 |
| 4,159,620 | 7/1979 | LaFlaquiere et al. | 57/301 |

*Primary Examiner*—Glen R. Swann, III

*Attorney, Agent, or Firm*—Holman & Stern

[57] ABSTRACT

An order produced by an interruption of yarn delivery at the exit of a spinning unit is cancelled so that the yarn-piecing automaton does not stop in front of the unit but continues to travel towards another spinning unit. At the same time, an alarm system is automatically triggered in order to warn operating personnel that a servicing operation is urgently required.

9 Claims, 2 Drawing Figures

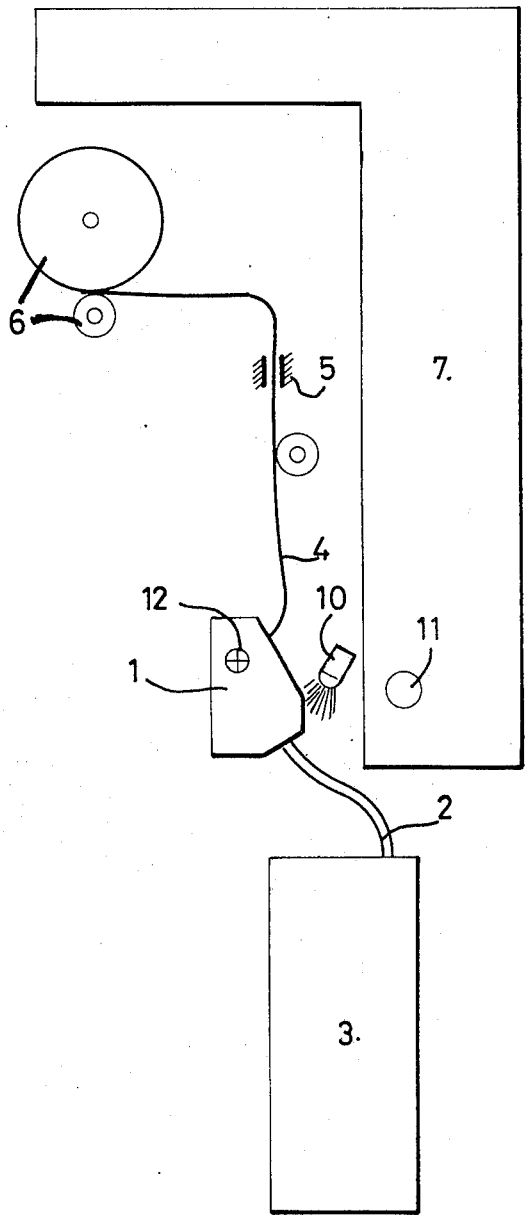
FIG.1
FIG.2
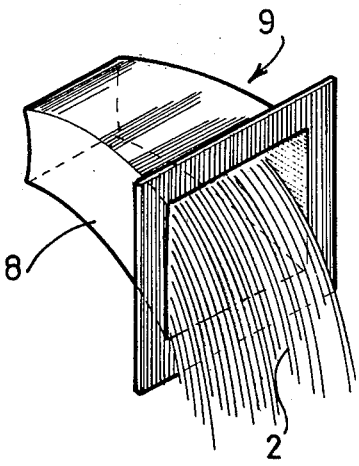

YARN-PIECING AND CLEANING SYSTEM FOR A SPINNING MACHINE

SUMMARY OF THE INVENTION

This invention relates to a yarn-piecing system for a freed-fiber spinning device.

The yarn-piecing system comprises an automaton whose main function is to piece together threads which have been accidentally broken during formation. This automaton moves continuously along a rail in front of the spinning units. When the yarn delivery is interrupted within one of these units, a device for checking the presence of the yarn gives the automaton the order to stop in front of said spinning unit and to carry out piecing of the yarn. The yarn-piecing operation is performed by bringing back the length of yarn which emerges from the nozzle of the corresponding spinning unit and by producing a partial vacuum within this latter in order to withdraw the end of said length of yarn by suction during operation of the unit. The end of the yarn thus introduced is mixed with the fibers as they are projected into the collecting duct of the rotor, is re-discharged from the machine and wound onto the bobbin, thus drawing with it the newly formed yarn.

At the time of an interruption of the fiber supply (when the feed can is empty, for example), the yarn-piecing automaton carries out its operation without success and accordingly remains stationary in front of a spinning unit which is out of service. Should it prove necessary to perform yarn-piecing operations on other units during this stationary period, they cannot be carried out by the automaton, thus producing a stoppage of said units and causing a drop in production of the spinning machine.

The aim of the invention is to overcome this disadvantage by cancelling the automaton-stopping order produced by interruption of the yarn delivery by superimposing thereon an order for continuation of travel of the automaton emanating from the absence of a fiber sliver within the feed duct. At the same time, this second order triggers an alarm for providing supervisory personnel with a warning to the effect that a servicing operation is urgently required.

BRIEF DESCRIPTION OF THE DRAWINGS

These and other features of the invention will be more apparent upon consideration of the following description and accompanying drawings in which one embodiment of the invention is illustrated by way of example and not in any limiting sense, and in which:

FIG. 1 is a highly diagrammatic view of a spinning unit, a yarn-piecing automaton being stopped in front of said unit and a device in accordance with the invention being installed on said automaton;

FIG. 2 is a view in perspective showing the duct for feeding fibers to the spinning unit.

DETAILED DESCRIPTION

The freed-fiber spinning unit 1 is supplied with a fiber sliver 2 which passes out of a feed can 3. The yarn 4 thus produced passes in front of a yarn breakage checking device 5 of known type before being taken up by the rollers 6. For a variety of reasons, it can happen that the yarn 4 breaks. In the event of such an occurrence, the checking device 5 (consisting of a switch, for example) closes and transmits a signal to an automaton 7 which accordingly stops in front of the spinning unit 1 for the purpose of piecing the yarn in accordance with a well-known mode of operation described in particular in U.S. Pat. No. 4,159,620 issued July 3, 1979. When the device 5 no longer detects the presence of the yarn 4, this absence of yarn may arise from faulty supply of the sliver 2.

From that time onwards, although the movement of the contact of the device 5 to the closed position has had the effect of transmitting an order to the automaton 7, the yarn-piecing operation cannot be performed by the automaton which therefore remains stationary in front of the spinning unit concerned as long as this latter is not supplied again with sliver. Accordingly, it becomes readily apparent that this immobilization of the automaton is liable to have an adverse effect on productivity by reason of the fact that, as long as the automaton does not receive any order to resume its travel, it cannot move to another spinning unit in which it may prove necessary to carry out a yarn-piecing and/or cleaning operation.

In order to overcome this drawback and in accordance with a first embodiment of the invention, the wall 8 of the duct 9 for supplying slivers 2 is formed of reflecting material such as a polished metal or metallized plastic material. When the duct wall is no longer covered by the sliver 2, the light emitted by a light source 10 mounted for example on the frame of the machine can accordingly be reflected from said duct wall to a photoelectric cell 11 mounted on the automaton 7. By means of an electric or electronic device of known type, the photoelectric cell transmits to the automaton 7 the order not to stop in front of the spinning unit 1. At the same time, the photoelectric cell triggers an alarm system 12 which is intended to warn supervisory personnel of the need to perform a servicing operation.

This alarm may be mounted at any suitable location of the spinning installation (on the spinning unit 1, for example) and can consist of a light or sound signal or a combination of both, the sound signal being intended to attract the operator's attention and the light signal being intended to permit rapid identification of the unit which is out of service.

In accordance with a second embodiment of the invention (not shown in the drawings), the sliver of fibers 2 passes in front of a proximity detector which is attached to one of the walls of the fiber feed duct. When delivery of fibers is interrupted, the distance between the proximity detector and the opposite wall of the feed duct is modified, thereby producing a signal which initiates displacement of the automaton and actuation of the alarm. This system does not make it necessary to provide the fiber feed duct with a special wall as was the case in the previous embodiment.

In accordance with a third embodiment of the invention (also omitted from the drawings), use is made of an electric microswitch which is fixed in such a manner as to ensure that the fiber sliver is applied against its control lever. When the fiber sliver is interrupted, the lever is accordingly released and initiates closing of the contact which is opened by the yarn checking device. Thus the automaton continues its travel instead of stopping in front of a spinning unit in which no yarn is present by reason of a failure of supply of fiber sliver and the alarm system is triggered.

One solution which proves particularly advantageous since the yarn-piecing automaton is associated with a device for delivering compressed air lies in the use of a pneumatic contact. The fiber sliver compresses the blade-spring which is released when the supply of fibers is interrupted. A valve then operates a micro-jack which in turn closes the electrical contact opened as a result of a yarn shortage and triggers the alarm.

The design solutions mentioned in the foregoing have been given solely by way of example and not in any limiting sense. Any device which is capable of cancelling the order transmitted to the automaton by the yarn shortage detector and of triggering the alarm system is included within the scope of the invention.

What is claimed is:

1. In an open-end yarn spinning machine having a plurality of spinning units, each including a fiber sliver supply means from which fiber slivers are fed to the input of said spinning unit, and at least one automaton carriage adapted to travel on rail means along said spinning units, each spinning unit being provided with detecting means operable to detect a break in the yarn downstream of said spinning unit and to deliver a signal in response to which said automaton carriage travels to a position adjacent said spinning unit for remedying the said yarn break by performing yarn-piecing operations, the improvement comprising second detector means operatively connected with said spinning unit for detecting the interruption of supply from said sliver supply means and emitting a signal to said automaton, receiving and control means operatively associated with said automaton carriage to receive said signal from said second detector and in response thereto override said yarn break detecting means to prevent said automaton carriage from stopping adjacent the spinning unit to which sliver supply from the sliver supply means has been interrupted and to enable it to travel to another spinning unit where a malfunction is detected.

2. An open-end spinning machine as claimed in claim 1 wherein said second detector comprises a photoelectric cell, a light reflecting surface on said spinning unit, a light source beamed onto said reflecting surface, said reflecting surface being positioned so that it is normally masked from said light means by said sliver being fed from said sliver supply means, said photoelectric cell being mounted on the machine in a position to receive the light from said light source reflected from said reflecting surface.

3. An open-end spinning machine as claimed in claim 2 wherein a duct is provided for feeding said sliver from the sliver supply means to said spinning unit through which said sliver passes, and said light reflecting surface comprises a wall of said duct.

4. An open-end spinning machine as claimed in claim 3 wherein said light source is mounted on said spinning unit and said photoelectric cell is mounted on said automaton carriage.

5. An open-end spinning machine as claimed in claim 1 and further comprising a sound and light alarm means operated by said second detector means.

6. An open-end spinning machine as claimed in claim 1 wherein a duct is provided for each spinning unit for feeding said sliver from the sliver supply means therethrough to said spinning unit, and said second detector comprises a proximity detector attached to the inside of one wall of said duct.

7. An open-end spinning machine as claimed in claim 1 wherein said second detector means comprises a mechanical feeler device mounted on the machine and operatively engaging said fiber sliver being fed to said spinning unit.

8. An open-end spinning machine according to claim 7, wherein said mechanical feeler is a control lever of an electrical microswitch and said microswitch is operatively connected to said receiving and control means.

9. An open-end spinning machine according to claim 7, wherein the mechanical feeler is a spring-blade of a pneumatic contact device.

* * * * *